United States Patent [19]

Newberry

[11] 4,378,860

[45] Apr. 5, 1983

[54] MOVABLE STAGING SCAFFOLD SYSTEM FOR BUILDING CONSTRUCTION

[76] Inventor: Claude C. Newberry, P.O. Box 1111, Silverdale, Wash. 98383

[21] Appl. No.: 257,329

[22] Filed: Apr. 24, 1981

[51] Int. Cl.[3] ..... E04G 3/10; E04G 3/16

[52] U.S. Cl. ..... 182/38; 182/14; 182/82; 182/129; 182/142

[58] Field of Search ..... 182/142, 145, 146, 36, 182/37, 38, 143, 12–14, 150, 129, 82; 187/6

[56] References Cited

U.S. PATENT DOCUMENTS

| | | | |
|---|---|---|---|
| 598,294 | 2/1898 | Robbins | 182/142 |
| 1,432,040 | 10/1922 | Schuler | 182/145 |
| 2,549,707 | 4/1951 | Plummer | 182/142 |
| 2,553,378 | 5/1951 | Miller | 182/37 |
| 2,692,168 | 10/1954 | Gregory | 182/37 |
| 2,814,533 | 11/1957 | Van Horne | 182/37 |
| 3,255,845 | 6/1966 | Gardner | 182/37 |
| 3,305,113 | 2/1967 | Gardner | 182/37 |
| 3,452,528 | 7/1969 | Fairchild | 182/37 |
| 3,724,594 | 4/1973 | Jonsson | 182/36 |
| 4,234,055 | 11/1980 | Beeche | 182/142 |

*Primary Examiner*—Reinaldo P. Machado
*Attorney, Agent, or Firm*—Christensen, O'Connor, Johnson & Kindness

[57] ABSTRACT

A work staging scaffold system comprising an open movable structural frame with horizontal track members mounting one or more sets of carriages that support one or more associated traverse tracks carrying vertically movable worker cars and also workpiece cable hoists.

15 Claims, 4 Drawing Figures

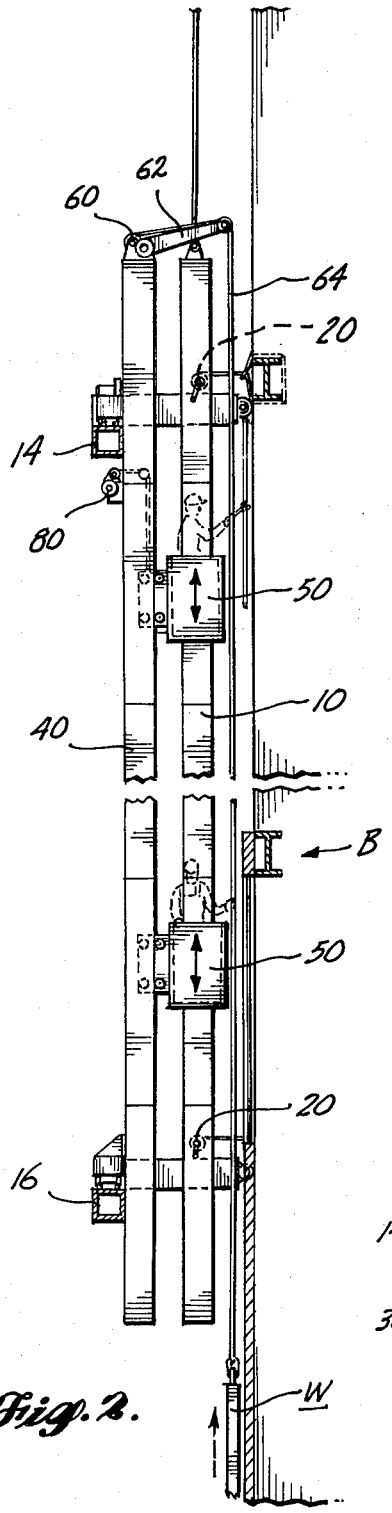
Fig. 2.
Fig. 3.
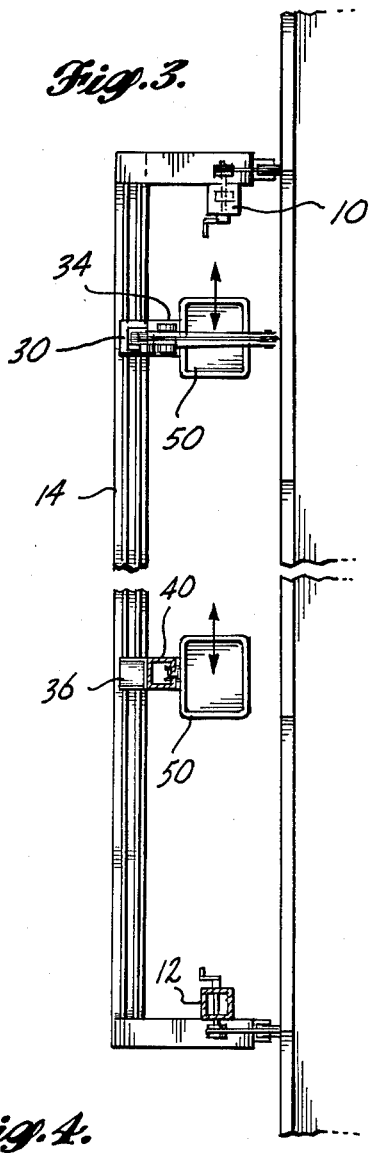
Fig. 4.
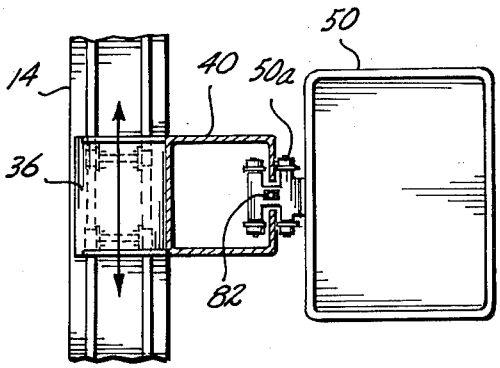

MOVABLE STAGING SCAFFOLD SYSTEM FOR BUILDING CONSTRUCTION

BACKGROUND OF THE INVENTION

This invention relates to a work staging scaffold system for use by workers in action on the side of a building structure such as during different stages in the application of exterior sheeting, the installation of window framing and panes, the mounting of trim, ect. More particularly, the invention concerns an improved scaffold system for workers, and particularly teams of workers, to position themselves and workpieces safely and conveniently at any of different places on the side of a building structure at each of different stages during the progress of construction, or of maintenance or repair work for that matter.

A further object of the invention is to provide a versatile system of the kind indicated adaptable to accommodate the positional needs and the support tool and workpiece hoisting needs of each of one or more workers positionally movable independently of each other, but also to the end of being able to function cooperatively, such as in handling and installing of large pieces of siding or sheeting and other cooperative operations. The improved system herein disclosed achieving those objectives and related purposes makes it possible for an individual worker or a crew of workers to complete the exterior of a framed building structure in a shorter time and with less effort and risk of injury than is believed possible with prior systems.

SUMMARY OF THE INVENTION

As herein disclosed, the present invention contemplates a staging scaffold system movable up and down and into different positions laterally across the face of a building structure for any of a variety of purposes. In the preferred embodiment disclosed, a pair of transversely spaced, elongated upright members are interconnected by a pair of elongated track members forming an open framework. At least one elongated upright traverse track extending between the track members is movably mounted thereon by carriages. A worker car movably mounted and guided on each traverse track is raised and lowered by cable winch means or the like, whereas an independent cable winch system also mounted upon the traverse track is provided for raising and lowering workpieces and tools in the space between the worker cars and the adjacent building structure. The system permits workers to cooperate from any of independently established related positions and to use cooperable lift systems to move panels, frames and other objects into position.

BRIEF DESCRIPTION OF DRAWINGS

FIG. 2 is a side (edge) sectional view of the apparatus taken on line 2—2 in FIG. 1; and FIG. 3 is a top view of the same.

FIG. 4 is an enlarged top view of one of the worker cars illustrating its means of support and guidance for movement.

DETAILED DESCRIPTION OF ILLUSTRATED EMBODIMENT

Figure 1:
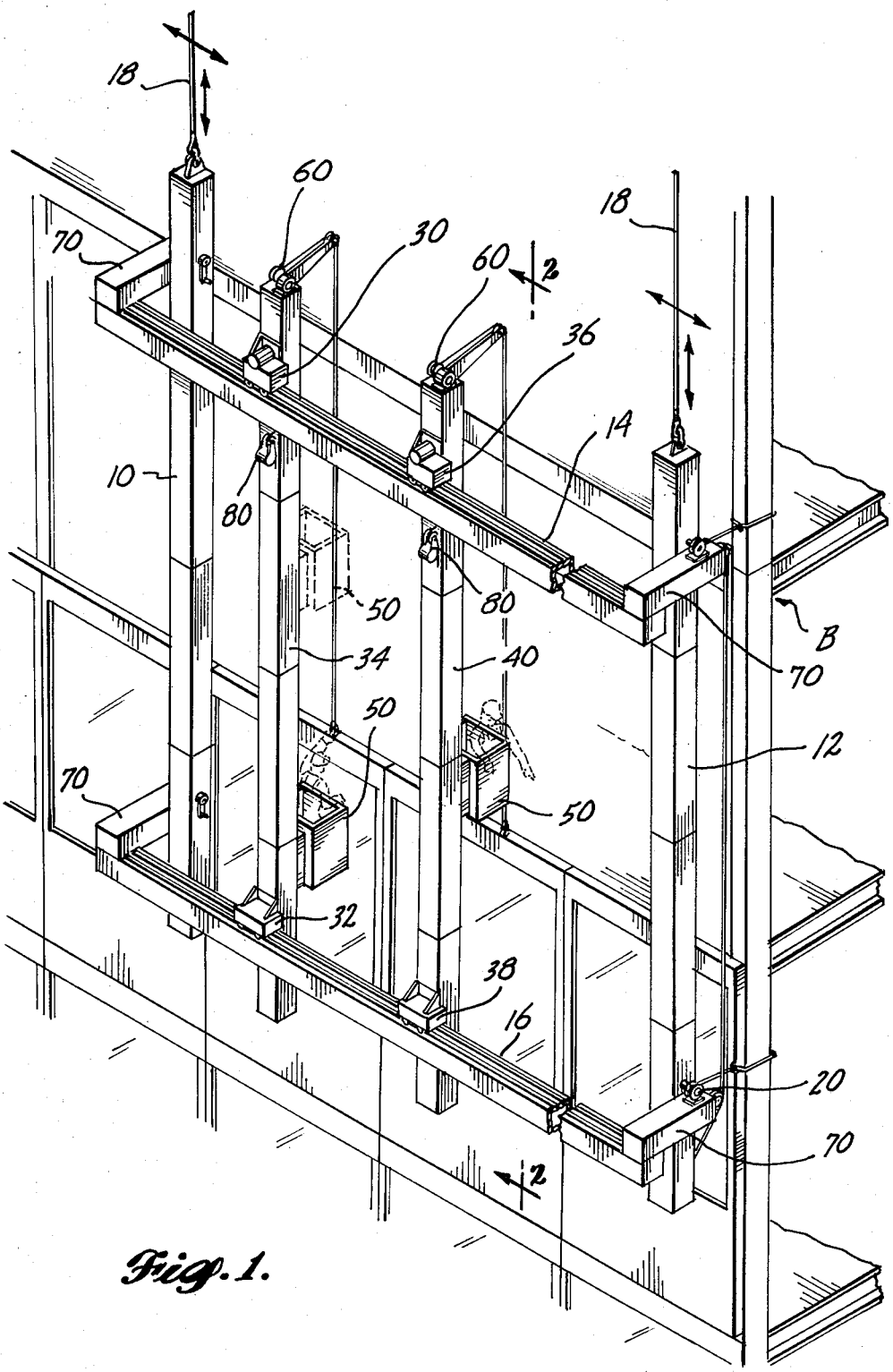
FIG. 1 is a top perspective view of the apparatus in its preferred form mounted for use on the side of a building structure.

In the illustrated system, elongated upright side members 10 and 12 are interconnected at top and bottom by horizontal track members 14 and 16 to form a framework which defines the work staging area. Suspended in working position from above by cables 18, such as from a carriage system or series of hoist mounts (not shown) at the top of the building structure B, the framework is intended to be movable up and down and horizontally along the face of the building structure into any of different positions as the building work progresses. In any set position, strapping cable winches 20 at top and bottom of each framework side member (10 and 12) are used to secure the framework against swaying in wind and against outward displacement due to work reaction forces being used. Because of these and the transverse spacing between suspension cables 18, the apparatus makes a highly stable base for the purposes intended.

Track members 14 and 16 provide running support and guidance for at least one set of carriages 30 and 32 engaging the respective track members. A columnar traverse track 34 mounted by its upper and lower end portions on these carriages on the building structure side of track members 14 and 16 is thus movable horizontally across the width of the open area of the framework. In most instances, a similar second set of carriages 36 and 38 movably mounting a second upright traverse track 40 is also provided in the system for reasons which will become evident.

Each traverse track (34 and 40) movably mounts and provides guidance to at least one worker pod or car 50 movable up and down into any of different positions along the building structure side of the associate traverse track. Thus, individual workers functioning either as a team or separately, as the work may require from time to time, have a safe and convenient base from which to operate and have the capability of shifting their positions over the entire face of the building structure in the course of a project.

Additionally, each traverse track 34 and 40 mounts at its top a cable hoist 60 with a cable guide sheave support arm 62 that projects inwardly into close proximity with the adjacent face of building structure B for the purpose of hoisting tools, workpieces and building sections (W) on cables 64 as shown. The worker car or cars 50 are set back safely and sufficiently from the face of the building to provide space for the raising and lowering of such items. This setback is made structurally convenient to achieve by mounting the track members 14 and 16 on the outwardly projecting ends of pairs of short cantilever support arms 70 rigidly mounted on the respective side members 10 and 12. The length of such arms 70 is made just sufficient to locate the worker cars within worker's arm's reach of the building structure B, mounted as they are on the bulidng side of traverse tracks 34 and 40, which in turn are mounted on the building side of track members 14 and 16.

Any conveniently suitable drive system or combination of drive systems may be incorporated to raise and lower the basic frame structure, to move it across the building structure face, to move the traverse track carriages along tracks 14 and 16 and to move the worker cars up and down the columnar traverse tracks 34 and 40. Cable winches 80 serve to raise and lower the worker cars on cables 82, with the cars themselves guided by suitable wheeled carriages 50 engaging the slotted wall of tracks 34 or 40 (FIG. 4). Preferably, motorized drives are employed in all winches and carriages (except strapping winches 20 which are preferably operated manually) with associated electric power cables and controls (not shown) leading to them from locations in the worker cars 50.

In practice, the work staging scaffold system framework can best be assembled by welding or bolting a kit of parts together on the job site. Once assembled and appropriately suspended along the side of building structure B, with traverse tracks in place, workers boarding the cars 50 are able to move from boarding positions at ground level, or at a higher level, to the places where work is to be done, doing so either independently of each other or cooperatively. The electrical drives and controls and the routings of power to the various drives are or may be state-of-art technology; hence, are not illustrated nor described in detail. Details of the carriages themselves and of the worker cars or pods may also vary and are or may be of relatively simple design using well-known mechanical features, as broadly depicted.

The combinations of features of novelty of this invention believed to represent the new and original advancement in the art are as set forth in the claims that follow.

The embodiments of the invention in which an exclusive property or privilege is claimed are defined as follows:

1. A building construction work staging scaffold system comprising a pair of transversely spaced, elongated parallel frame members, a pair of elongated transversely spaced track members extending transversely between said frame members and interconnecting the same to form an open staging area framework, means for suspending said framework alongside a building structure and adapted to permit shifting the suspended positioning of said framework as the work progresses, at least one elongated traverse track extending transversely between said track members, a first set of carriage means movably engaging the respective track members and movably supporting the traverse track thereon for translational movement along said track members, at least one worker car movably mounted on said traverse track, and means operable to move said car along said traverse track.

2. The scaffold system defined in claim 1, further including a second elongated traverse track extending transversely between said track members, a second set of carriage means movably engaging the respective track members and movably supporting the traverse track thereon for translational movement along said track members, a second worker car movably mounted on said second traverse track, means operable to move said second car along said second traverse track.

3. The scaffold system defined in claim 2 wherein the means operable to move the second car is operable independently of the means operable to move the first car.

4. The scaffold system defined in claim 3, including means operable to move the first and second traverse tracks independently of each other along said track members.

5. The scaffold system defined in claim 2, including means operable to move the first and second traverse tracks independently of each other along said track members.

6. The scaffold system defined in claim 1 wherein the framework includes means to suspend the same with its frame members extending vertically.

7. The scaffold system defined in claim 6, further including a second elongated traverse track extending between said track members, a second set of carriage means movably engaging the respective track members and movably supporting the traverse track thereon for translational movement along said track members, a second worker car movably mounted on said second traverse track, means operable to move said second car along said second traverse track.

8. The scaffold system defined in claim 7 wherein the means operable to move the second car is operable independently of the means operable to move the first car.

9. The scaffold system defined in claim 8, including means operable to move the first and second traverse tracks independently of each other along said track members.

10. The scaffold system defined in claim 7, including means operable to move the first and second traverse tracks independently of each other along said track members.

11. The scaffold system defined in claim 7 further including at least one workpiece hoist means mounted on the upper end of at least one of said traverse tracks and including a hoist cable and means guiding the hoist cable to raise and lower workpieces between the side of the building and the worker cars.

12. The scaffold system defined in claim 9 further including at least one workpiece hoist means mounted on the upper end of at least one of said traverse tracks and including a hoist cable and means guiding the hoist cable to raise and lower workpieces between the side of the building and the worker cars.

13. The scaffold system defined in claim 7 further including a workpiece hoist means mounted on the upper end of said traverse track and including a hoist cable and means guiding the hoist cable to raise and lower workpieces between the side of the building and the worker car.

14. The scaffold system defined in claim 13 wherein the means to move the worker car includes a second hoist means, including a hoist cable, and cable guide means on the upper end of the traverse track to raise and lower the worker car on said traverse track.

15. The scaffold system defined in claim 14 wherein the means to move the worker car includes second hoist means including hoist cables, and cable guide means on the upper ends of the respective traverse tracks to raise and lower the worker cars on said traverse tracks.

* * * * *

UNITED STATES PATENT AND TRADEMARK OFFICE

CERTIFICATE OF CORRECTION

PATENT NO. : 4,378,860

DATED : April 5, 1983

INVENTOR(S) : Claude C. Newberry

It is certified that error appears in the above—identified patent and that said Letters Patent is hereby corrected as shown below:

Column 1, line 11, "ect." should be —etc.—

Column 2, line 57, "bulidng" should be —building—

Column 4, line 12, Insert —transversely— before "between"

Signed and Sealed this

*Twenty-first* Day of *June 1983*

[SEAL]

*Attest:*

DONALD J. QUIGG

*Attesting Officer*

*Acting Commissioner of Patents and Trademarks*